United States Patent [19]

LeBegue et al.

[11] Patent Number: 4,840,432

[45] Date of Patent: Jun. 20, 1989

[54] CONTINUOUS MINER WITH DUCT ASSEMBLY

[75] Inventors: Maurice K. LeBegue; Henry E. Wilson, both of Fairmont, W. Va.

[73] Assignee: Baker International Corporation, Orange, Calif.

[21] Appl. No.: 76,155

[22] Filed: Jul. 21, 1987

[51] Int. Cl.[4] ..... E21C 35/22

[52] U.S. Cl. ..... 299/64; 299/76

[58] Field of Search ..... 299/12, 18, 64, 76, 299/78, 53, 54, 43

[56] References Cited

U.S. PATENT DOCUMENTS

| | | | |
|---|---|---|---|
| 2,694,563 | 12/1954 | Graham | 299/86 X |
| 2,788,202 | 4/1957 | Barrett | 299/76 |
| 3,062,518 | 11/1962 | Osgood | 262/9 |
| 3,197,256 | 7/1965 | Hlinsky | 299/64 |
| 3,479,090 | 11/1969 | McCracken | 299/64 |
| 3,498,676 | 3/1970 | Cilles | 299/64 |
| 3,499,684 | 3/1970 | McCracken | 299/64 |
| 3,516,712 | 6/1970 | Bennett et al. | 299/64 |
| 3,614,162 | 10/1971 | Teeter | 299/67 |
| 3,712,678 | 1/1973 | Amoroso | 299/68 |
| 3,730,593 | 5/1973 | Karlovsky, Jr. | 299/76 |
| 3,774,969 | 11/1973 | LeBegue | 299/76 |
| 3,801,157 | 4/1974 | Munger | 299/64 |
| 3,810,677 | 5/1974 | David | 299/64 |
| 3,848,930 | 11/1974 | LeBegue | 299/76 |
| 3,874,735 | 4/1975 | Delli-Gatti, Jr. | 299/68 |
| 3,966,258 | 6/1976 | Dolecki | 299/64 X |
| 4,076,315 | 2/1978 | Gundlach et al. | 299/64 |
| 4,076,316 | 2/1978 | LeBegue | 299/64 |
| 4,088,371 | 5/1978 | LeBegue et al. | 299/76 |
| 4,090,601 | 5/1978 | Freed, Jr. | 198/316 |
| 4,133,582 | 1/1979 | Kogelmann | 299/64 |
| 4,200,335 | 4/1980 | Moynihan et al. | 299/1 |
| 4,202,434 | 5/1980 | Herron | 198/316 |
| 4,225,189 | 9/1980 | LeBegue | 299/71 |
| 4,248,611 | 2/1981 | McGuire et al. | 55/238 |
| 4,249,778 | 2/1981 | McGuire | 299/64 |
| 4,253,705 | 3/1981 | LeBegue | 299/76 |
| 4,270,803 | 6/1981 | Baum | 299/76 |
| 4,281,879 | 8/1981 | LeBegue et al. | 299/64 |
| 4,310,199 | 1/1982 | Freed, Jr. et al. | 299/76 |
| 4,360,235 | 11/1982 | Mendola | 299/64 |
| 4,380,353 | 4/1983 | Campbell et al. | 299/64 X |
| 4,380,354 | 4/1983 | LeBegue | 299/18 |
| 4,486,051 | 12/1984 | Becker | 299/78 |
| 4,531,784 | 7/1985 | Karlovsky | 299/64 |
| 4,557,524 | 12/1985 | Melhuish | 299/64 |

OTHER PUBLICATIONS

"Joy 12CM Continuous Miner Technical Service Manual", on pp. 85 and 86, published by Joy Manufacturing Company, Franklin Pennsylvania, during 1979.

*Primary Examiner*—Jerome W. Massie, IV
*Assistant Examiner*—David J. Bagnell
*Attorney, Agent, or Firm*—Stanley J. Price, Jr.

[57] ABSTRACT

A self-propelled continuous mining machine includes a mobile frame assembly having a front end portion with a boom assembly pivotally retained thereon. The outer end portion of the boom assembly carries a dislodging head for removing material from a mine face. A plurality of connections pivotally connects the boom assembly to the mobile frame assembly. A dust collecting system is positioned on the mobile frame assembly for inducing a flow of air through a hollow interior portion of the boom assembly. As the dislodging head removes material from a mine face, the dust collecting system draws airborne dust created by the dislodging head through a hollow interior of the boom assembly and into the collecting system mounted on the mobile frame assembly. A portion of the boom assembly is pivotally connected to a portion of the collecting system mounted on the mobile frame assembly to provide a pivoting joint to allow the collecting system to draw airborne dust through the boom assembly with the boom assembly in any preselected position relative to the mobile frame assembly. A conveying system mounted on the mobile frame assembly receives material from the dislodging head and transports the material rearwardly of the machine.

13 Claims, 2 Drawing Sheets

CONTINUOUS MINER WITH DUCT ASSEMBLY

BACKGROUND OF THE INVENTION

1. Field Of The Invention

This invention relates to a mining machine, and more particularly, to a continuous miner which includes a mobile frame assembly and a boom assembly pivotally secured to the mobile frame assembly by a plurality of connectors which distribute the load placed on the boom assembly as the boom assembly is pivoted upwardly from the mobile frame assembly evenly throughout the boom structure, and to a dust collecting system for collecting airborne particles produced as a material dislodging head mounted on the end of the boom assembly dislodges material from a mine face.

2. Description Of The Prior Art

In underground mining, it is well known to provide a continuous mining machine which includes a material dislodging head positioned on the front end of the mining machine for dislodging material from a mine face. The dislodged material is conveyed rearwardly of the mining machine by a conveying system positioned on the continuous mining machine. The continuous mining machine is designed to continuously advance and dislodge material being mined to form an entry or tunnel in the material seam.

Various types of continuous mining machines having different types of tilting of pivoting mining heads are known. U.S. Pat. No. 2,986,384 discloses a mining machine having tiltable, dual mining heads. U.S. Pat. Nos. 3,479,090 and 3,495,876 disclose continuous mining machines each having a pivoting structure for supporting a mining head.

U.S. Pat. No. 3,498,676 discloses a continuous mining machine having a mining head that is positioned at the top of the mine face. The mining head is advanced into the mine face and traversed downwardly through the mine face to cut and break the material out of the mine face. The mining machine is supported on traction treads by which the machine is propelled forwardly to advance the mining head into the mine face.

U.S. Pat. No. 3,499,684 discloses a mining machine with a mining head positioned at the forward end of the machine. Traction means propels the mining machine, and gathering means collects the mined material and transfers the material to a conveyor for moving the mined material to the rear of the machine. The mining head is positioned on a boom that is movable upwardly and downwardly about the transverse axis of a pivot support on the machine main frame.

U.S. Pat. No. 3,516,712 discloses a continuous mining machine with a transverse rotary mining head for mining material from the entire area of the mine face by traversing the mining head through the mine face.

U.S. Pat. No. 3,874,735 discloses a continuous mining machine adapted for low overhead coal seams having a relatively small diameter cutter head of the non-oscillating or fixed head type driven by chains that also cut coal and convey it rearwardly to a gathering head mounted on the front of the machine. The gathering head carries a pair of counter-rotating discs having veins cooperating with conveyor fences for sweeping and discharging coal to a conventional conveyor mounted on the machine chassis.

U.S. Pat. No. 3,966,258 discloses a mining machine having a disintegrating head carried on the front end of the machine by a pivotal link arrangement.

In continuous underground mining, it is also known to provide a mining machine which includes a dust collecting system mounted thereon for collecting airborne dust particles produced as the mining machine cutting or dislodging head operates. The dust collecting system provides a relatively clean environment for the mining machine operator.

U.S. Pat. No. 3,712,678 discloses a continuous miner which is provided with a dust collecting system comprising boom-carried ducting adapted to receive dust-entrained air adjacent and rearwardly of the mining head. The mining machine chassis carries ducting which is operable to alternatively discharge the air to opposite sides of the machine. Counter-rotating centrifugal fans mounted in the boom-carried ducting draw dust-entrained air to such ducting whereby the air flows therethrough to the chassis-carried ducting. Scrubbers or cleaners are operatively associated with the boom-carried ducting for removing larger dust particles from the air.

U.S. Pat. No. 3,810,677 discloses a mining machine having a boom enclosed dust collector assembly for use in a coal mining operation wherein the dusty air from a mining operation is gathered directly from the operation, collected in the mining machine boom and selectively wetted and separated by centrifugal processing into a coal slurry for disposal. The clean air is exhausted to atmosphere. The coal slurry is discharged from the mining machine boom through a flexible hose which lies on the ground along a side of the machine.

U.S. Pat. No. 4,380,353 discloses a dust control system for a mining machine comprising a ductwork system having intakes adjacent the cutter head of the mining machine. A fan draws air through the ductwork system, and a flooded bed scrubber in the ductwork system upstream from the fan entrains the dust in droplets of water. The dust laden water is pumped to a point adjacent the cutting head.

U.S. Pat. No. 4,557,524 discloses a continuous mining machine having a dust control system which includes a generally rectangular intake duct section associated with the boom and a generally rectangular fixed duct section mounted on the vehicle. A transition section is connected to the intake of the fixed duct section. The transition section consists of a two piece arrangement wherein each piece is hinged to the intake duct section and is capable of slidingly engaging the fixed duct section at the end thereof adjacent the boom to sealingly couple the intake duct section to the fixed duct section as the boom swings upwardly and downwardly.

Although the prior art continuous mining machines include various types of cutting heads pivotally mounted on the mining machine, there is a need for an improved mining machine having a boom assembly pivotally connected to the mining machine frame assembly by a plurality of connectors which distribute the load on the mining machine boom assembly as it is pivoted upwardly from the mining machine frame assembly evenly throughout the boom assembly structure. Further, there is a need for a simple efficient dust collecting system whereby dust produced as a dislodging head dislodges material from a mine face is passed through a boom assembly hollow interior portion to a dust collecting system mounted on the mining machine frame. A portion of the boom assembly forms a pivoting joint with a portion of the dust collecting system positioned on the mobile frame assembly to allow airborne dust particles to be withdrawn from the mine face as the boom assembly pivots upwardly and downwardly relative to the mobile frame assembly.

SUMMARY OF THE INVENTION

In accordance with the present invention, there is provided a continuous mining machine for use in an underground mine which includes a mobile frame assembly and a boom assembly extending from the mobile frame assembly. The boom assembly has a first end portion pivotally connected to the mobile frame assembly by a plurality of connecting means and a second end portion spaced from the first end portion. The boom assembly first end portion is pivotally connected to the mobile frame assembly to permit upward and downward pivotal movement of the boom assembly relative to the mobile frame assembly. A material dislodging head is connected to the boom assembly second end portion. The plurality of connecting means are positioned on the boom assembly to distribute the load placed on the boom assembly as it is pivoted upwardly from the mobile frame assembly evenly through the boom assembly structure.

The boom assembly has a hollow interior portion with an air inlet portion connected to the hollow interior portion at the boom assembly second end portion and an air outlet portion at the boom assembly first end portion. A Collecting means is positioned on the mobile frame assembly. The collecting means induces a flow of air through the boom assembly hollow interior portion. As the disloding head operates to dislodge material from a mine face, the collecting means draws airborne dust produced by the disloding head through the hollow interior portion of the boom assembly into the collecting means positioned on the mobile frame assembly. A portion of the boom assembly air outlet portion is pivotally connected to a portion of the mobile frame assembly collecting means to allow the collecting means to continually draw airborne dust from the mine face as the boom assembly pivots upwardly and downwardly relative to the mobile frame assembly.

The continuous mining machine further includes a conveying system which extends longitudinally through the center of the mining machine. The conveying system includes a longitudinal first section which extends from the front end of the mobile frame assembly to the rear end of the mobile frame assembly. The conveying system also includes a conveyor second section pivotally connected to the conveyor first section which extends rearwardly from the rear end of the mobile frame assembly. The conveyor second section is pivotally connected to the conveyor first section for selected lateral and vertical movement relative to the conveyor first section. Material removed from the mine face by the dislodging head is transferred rearwardly of the mining machine along the conveyor system first and second sections by a plurality of spaced flights. The conveyor second section is pivoted relative to the conveyor first section to deposit dislodged material at predetermined locations rearwardly of the mining machine.

Accordingly, the principle object of the present invention is to provide a continous mining machine which includes a boom assembly pivotally connected to the mining machine mobile frame assembly by a plurality of connecting means.

Another object of the present invention is to provide a continuous mining machine having a boom assembly pivotally connected to a mobile frame assembly by a plurality of connecting means suitably positioned on the boom assembly to distribute the loading created on the boom assembly as the boom assembly is pivoted upwardly relative to the mobile frame assembly evenly throughout the boom assembly structure.

A further object of the present invention is to provide a continuous mining machine which includes a dust collecting system positioned on the mobile frame assembly for inducing a flow of air through a hollow interior portion of the boom assembly as the boom assembly pivots upwardly and downwardly relative to the mobile frame assembly.

Still another object of the present invention is to provide a continuous mining machine which includes a conveying system longitudinally positioned on the mobile frame assembly to receive material dislodged from a mine face by a dislodging head and transfer the dislodged material rearwardly from the mine face.

These and other objects of the present invention will be more completely disclosed and described in the following specification, the accompanying drawings and the appended claims.

DESCRIPTION OF THE PREFERRED EMBODIMENTS

Figure 1:
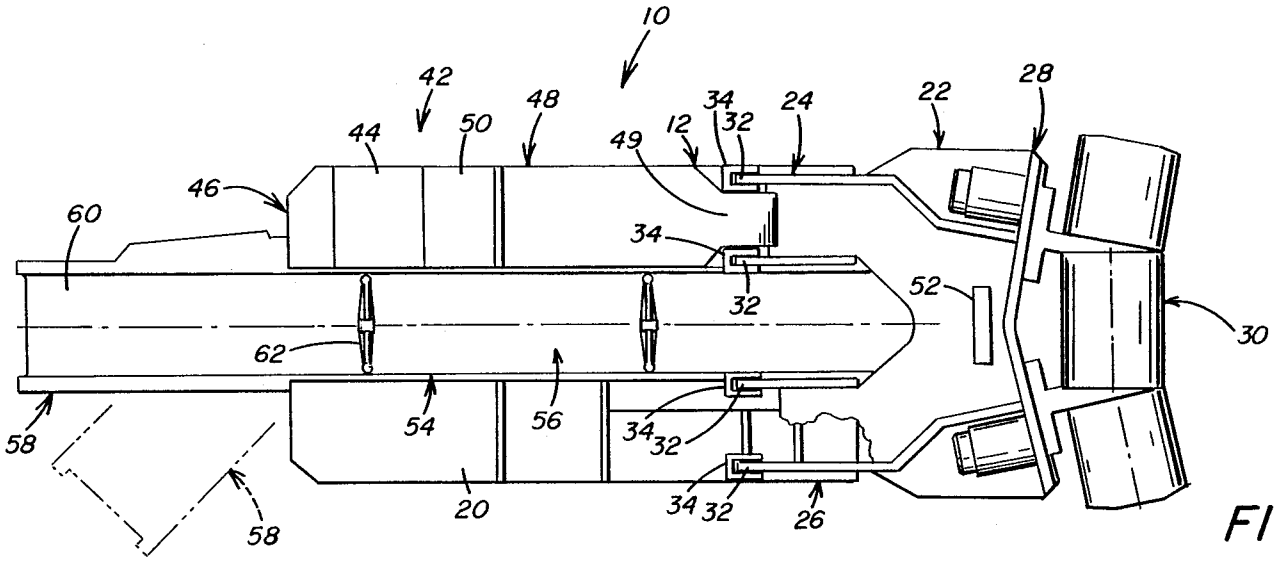
FIG. 1 is a top plan view of a self-propelled continuous mining machine which is the subject of this invention.
Figure 2:
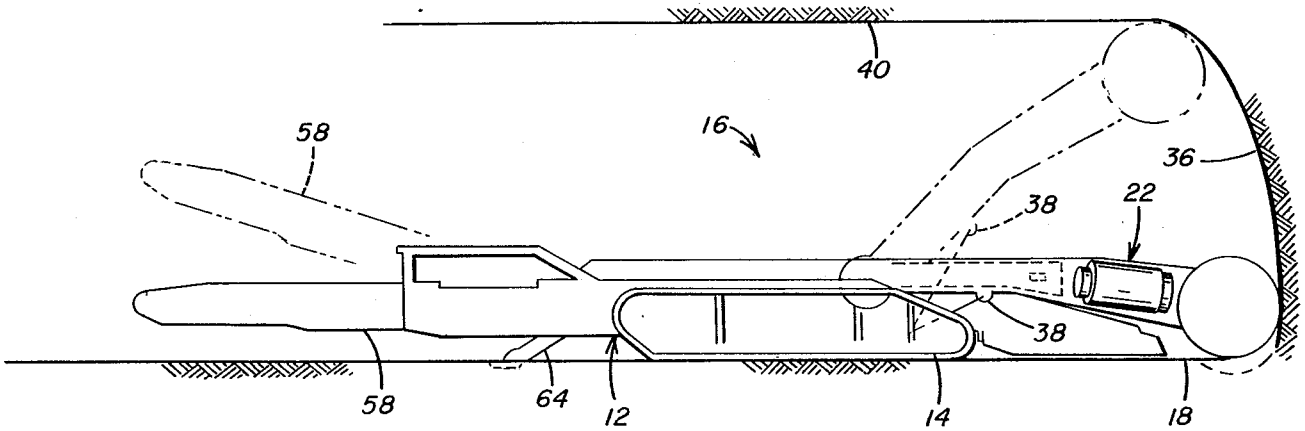
FIG. 2 is a view in side elevation of the continuous mining machine shown in FIG. 1, illustrating a boom assembly having a dislodging head secured thereto resting on a mine floor, and illustrating in phantom the boom assembly pivoted upwardly relative to the mining machine to show the extent of travel of the boom assembly.

Referring to the drawings, and particularly to FIGS. 1 and 2, there is illustrated a continuous mining machine generally designated by the numeral 10 for use in an underground mine to dislodge material from a mine face. Continuous mining machine 10 includes a mobile frame assembly 12 and a pair of ground engaging traction means 14 (one shown) positioned at each side of mobile frame assembly 12 for propelling mining machine 10 within a mine 16 along the floor 18 thereof.

Continuous mining machine 10 is capable of being operated from an operating station 20 in a manner similar to other such machines to dislodge material from a mine face 36 and transport it rearwardly of the rear end 46 of mining machine 10. Accordingly, mining machine 10 includes operating controls and sources of power for operating ground engaging traction means 14 and other equipment included thereon.

Mining machine 10 includes a boom assembly 22 having a first end section 24 pivotally secured to the front end 26 of mobile frame assembly 12. Boom assembly 22 also includes a second end section 28. As seen in FIGS. 1 and 2, a material dislodging head generally designated by the numeral 30 is connected to boom assembly 22 second end section 28. Although a material dislodging head such as dislodging head 30 is illustrated in the Figures, it should be understood that any desired dislodging head 30 known in the art may be secured to boom assembly 22 second end section 28.

Boom assembly 22 also includes four longitudinally extending engaging plates 32 which extend rearwardly from boom assembly 22 first end section 24 to engage four retainers 34 secured to the front end 26 of mobile frame assembly 12. Boom assembly 22 engaging plates 32 are pivotally secured to the mobile frame assembly 12 retainers 34 to allow boom assembly 22 to be pivoted upwardly and downwardly relative mobile frame assembly 12. In this manner, as boom assembly 22 is pivoted upwardly and downwardly relative to mobile frame assembly 12, dislodging head 30 may be operated to dislodge material from a face 36 of the mine 16.

Although not specifically illustrated in the Figures, actuating cylinders, preferably hydraulic cylinders, are connected at one end to front end 26 of mobile frame assembly 12. The other ends of the actuating cylinders are connected to retainers 38 one shown in FIG. 4) on boom assembly 22. As the actuating cylinders extensible rod portions are extended outwardly from their respective cylinder bodies, boom assembly 22 pivots vertically relative to mobile frame assembly 12 to allow dislodging head 30 to dislodge material from the full vertical surface of mine face 36. As seen in FIG. 2, since boom assembly 22 is pivotally connected to mobile frame assembly 12, boom assembly 22 travels in an arcuate path between mine floor 18 and mine roof 40 as dislodging head 30 dislodges material from mine face 36. As also seen in FIG. 2, boom assembly 22 is capable of downward arcuate movement to allow dislodging head 30 to travel below the surface of mine floor 18.

As illustrated in phantom in FIG. 2, since boom assembly 22 is pivotally secured to mobile frame assembly 12, boom assembly 22 travels in an arcuate path from a point beneath mine floor 18 to mine roof 40. As boom assembly 22 pivots upwardly towards mine roof 40, the weight of boom assembly 22 and dislodging head 30 creates torsional loading on the four pivot pins (not shown in FIGS. 1 and 2) which secure boom assembly 22 engaging plates 32 to mobile frame assembly 12 retainers 34. However, since boom assembly 22 is pivotally connected to mobile frame assembly 12 by four engaging plates 32, this four point connection allows the torsional loading created as boom assembly 22 and dislodging head 30 are pivoted upwardly towards mine roof 40 to be evenly spread throughout boom assembly 22. This four point connection reduces the wear on the pivot pins and provides a sturdy connection between boom assembly 22 and mobile frame assembly 12.

Mining machine 10 also includes a dust collecting system generally designated by the numeral 42. Dust collecting system 42 is operable to remove airborne particles produced as dislodging head 30 dislodges material from mine face 36 to provide a clean working environment for the mining machine 10 operator. Dust collecting system 42 includes a fan assembly 44 mounted on mobile frame assembly 12 at the rear end 46 of mining machine 10. Dust collectors 50 is also positioned on mobile frame assembly 12 and is connected to fan assembly 44. Duct assembly 48, which runs longitudinally along mobile frame assembly 12, has an end portion connected to a dust collector 50 and an opposite end portion which extends between a pair of retainers 34 on mobile frame assembly 12. As will be explained later in greater detail, duct assembly 48 includes a top wall 49 and a bottom wall 51 each having formed, arcuate end sections. As will also be explained later in greater detail and illustrated in FIG. 4, boom assembly 22 includes a hollow interior portion 78 and an air inlet 52 which form a part of dust collecting system 42. A portion of boom assembly 22 forms a pivoting joint with the formed, arcuate end sections of duct assembly 48 top wall 49 and bottom wall 51.

As dislodging head 30 operates to dislodge material from mine face 36, fan assembly 44 draws airborne dust produced by dislodging head 30 into boom assembly 22 air inlet portion 52 and through the hollow interior 78 of boom assembly 22 into duct assembly 48 positioned on mobile frame assembly 12. The dust which passes through duct assembly 48 is collected in dust collector 50. As described, dust collecting system 42 withdraws airborne dust from the area adjacent mine face 36 for the safety of the mining machine 10 operator. The pivoting joint formed from duct assembly 48 and boom assembly 22 allows collecting system 42 to draw airborne dust away from mine face 36 as boom assembly 22 is pivoted upwardly and downwardly on mobile frame assembly 12.

Mining machine 10 also includes a conveyor system generally designated by the numeral 54. Conveyor system 54 extends longitudinally from the front end 26 of mobile frame assembly 12 to a location rearwardly of the rear end 46 of mobile frame assembly 12. Conveyor system 54 includes a conveyor first section 56 which extends longitudinally through the center of mobile frame assembly 12. Conveyor system 54 also includes a conveyor second section 58 which extends rearwardly of the rear end 46 of mobile frame assembly 12 and is pivotally connected to conveyor first section 56 for lateral movement relative to conveyor first section 56. In this manner, conveyor second section 58 can be suitably positioned to deposit material provided to conveyor system 54 by dislodging head 30 at a preselected location rearwardly of rear end 46 of mining machine 10. Further, as illustrated in phantom in FIG. 2, conveyor second section 58 may be inclined to conveyor first section 56 if it is desired to deposit the dislodged material into a receiver. Conveyor first and second sections 56, 58 include a common conveyor deck 60. A plurality of spaced flights 62 transport material dislodged by dislodging head 30 rearwardly of the rear end 46 of mining machine 10 along the conveyor deck 60 of conveyor first section 56 and conveyor second section 58.

As seen in FIG. 2, mining machine 10 also includes a stabilizer 64 which is pivotally connected to mobile frame assembly 12. Before mining machine 10 commences operation to dislodge material from mine face 36, stabilizer 64 is extended downwardly to contact mine floor 18. As boom assembly 22 and dislodging head 30 are pivoted vertically relative to mobile frame assembly 12 to dislodge material from mine face 36, stabilizer 64 operates to stabilize the rear end 46 of mining machine 10 to prevent vertical movement of the rear end 46 of mining machine 10.

Figure 3:
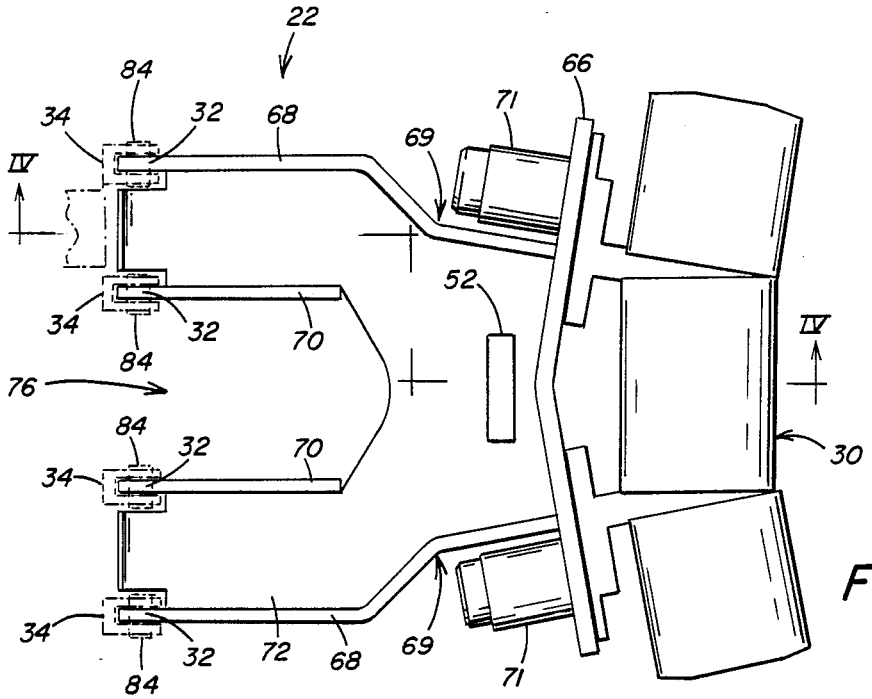
FIG. 3 is a top plan view of a boom assembly, illustrating in phantom the boom assembly connections to the mining machine.
Figure 4:
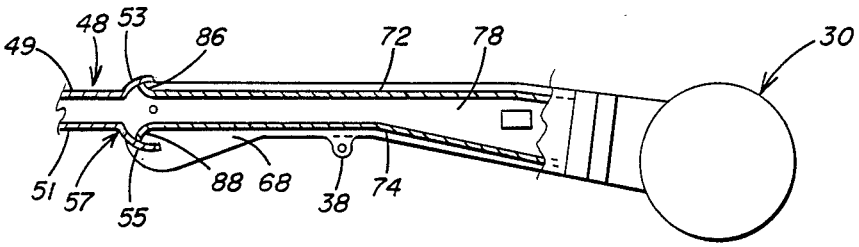
FIG. 4 is a partial fragmentary view in side elevation of the boom assembly shown in FIG. 3, illustrating a pivoting joint connection which is the subject of this invention.

Referring to FIGS. 3 and 4, there is illustrated boom assembly 22 previously described. Boom assembly 22 includes a generally transverse front wall 66 and a pair of generally longitudinally extending outer sidewalls 68 connected to transverse front wall 66. Generally longitudinally extending outer sidewalls 68 each include a bent portion 69 which provides clearance for the dislodging head 30 drive motors 71.

Boom assembly 22 also includes a horizontally extending top wall 72 and a horizontally extending bottom wall 74. Horizontally extending top wall 72 and horizontally extending bottom wall 74 are connected between the generally longitudinally extending outer sidewalls 68. Horizontally extending top and bottom walls 72, 74 are also connected to transverse front wall 66.

As seen in FIG. 3, top wall 72 and bottom wall 74 each include a generally U-shaped cutout 76. The generally U-shaped cutouts 76 in horizontally extending top wall 72 and horizontally extending bottom wall 74 provide clearance for conveyor first section 56 which passes longitudinally through the center of mobile frame assembly 12.

A pair of longitudinally extending inner sidewalls 70 are connected between horizontally extending top wall 72 and horizontally extending bottom wall 74 as shown in FIG. 3. As seen, the arrangement of generally longitudinally extending outer sidewalls 68, longitudinally extending inner sidewalls 70, transverse front wall 66 and horizontally extending top and bottom walls 72, 74 provide boom assembly 22 with the hollow interior 78 previously described.

As seen in FIG. 3, the pair of generally longitudinally extending outer sidewalls 68 include a pair of outer sidewall plates 32 arranged to be received by a pair of generally U-shaped retainers 34 secured on mobile frame assembly 12 and illustrated in phantom. Similarly, the pair of longitudinally extending inner sidewalls 70 include a pair of inner sidewall plates 32 arranged to be received by another pair of generally U-shaped retainers 34 secured on mobile frame assembly 12 and illustrated in phantom. Outer sidewall plates 32 and inner sidewall plates 32 represent the engaging plates 32 previously described.

Outer sidewall plates 32, inner sidewall plates 32 and the four retainers 34 each include aligned holes to receive four pivot pins 84. As earlier described, boom assembly 22 pivots upwardly and downwardly about pivot pins 84 as the actuating means (not shown) operates to raise and lower boom assembly 22 relative to mobile frame assembly 12. This four pivot pin arrangement evenly distributes the torsional loading placed on boom assembly 22 as boom assembly 22 and dislodging head 30 are pivoted upwardly relative to mobile frame assembly 12. Since the torsional loading is evenly distributed throughout the four pivot pins 84, frictional wearing on each pivot pin 84 is reduced, and the frictional wearing on the pivot pin receiving holes in outer sidewall plates 32 and inner sidewall plates 32 is also reduced.

Referring to FIG. 4, there is illustrated the pivoting joint previously described. The pivoting joint is generally designated by the numeral 57. Horizontally extending top wall 72 and horizontally extending bottom wall 74 include formed, arcuate ends 86 and 88, respectively, positioned between a pair of engaging means 34 illustrated in FIG. 3.

As earlier described, collecting system 42 duct assembly 48 includes duct top wall 49 and duct bottom wall 51 having formed, arcuate ends 53 and 55 respectively. As seen in FIG. 4, horizontally extending top wall 72 and horizontally extending bottom wall 74 arcuate ends 86, 88 contact the inner surfaces of arcuate ends 53, 55 of duct top wall 49 and duct bottom wall 51, respectively, to form pivoting joint 57 between boom assembly 22 and duct assembly 48.

As boom assembly 22 is pivoted upwardly or downwardly relative to mobile frame assembly 12, arcuate ends 86 and 88 pivotally contact the inner surfaces of duct assembly 48 arcuate ends 53 and 55 to provide a sealed, pivoting joint 57. In this manner, as fan assembly 44 operates to draw airborne dust produced by dislodging head 30 through air inlet 52 and boom assembly 22 hollow interior 78, the dust passes through pivoting joint 57 formed by arcuate ends 86, 88 and arcuate ends 53, 55 into duct assembly 48. As boom assembly 22 is raised and lowered relative to mobile frame assembly 12 to allow dislodging head 30 to remove material from the full vertical surface of mine face 36, the dust produced by dislodging head 30 is passed through the hollow interior 78 of boom assembly 22 into duct assembly 48 by means of pivoting joint 57. As seen, collecting system 42 can operate to withdraw airborne dust from mine face 36 regardless of the position of boom assembly 22 relative to mobile frame assembly 12. As described, the pivoting joint 57 formed by arcuate ends 86, 88 and arcuate ends 53, 55 eliminates the need for flexible or telescoping duct connections between duct assembly 48 and boom assembly 22.

According to the provision of the patent statutes, I have explained the principle, preferred construction and mode of operation of my invention and have illustrated and described what I now consider to represent its best embodiments. However, It should be understood that, within the scope of the appended claims, the invention may be practiced otherwise than as specifically illustrated and described.

I claim:

1. A continuous miner comprising a mobile frame assembly having a front end portion and a rear end portion, a boom assembly extending from said mobile frame assembly, said boom assembly having a first end portion pivotally connected to said mobile frame assembly by a plurality of connecting means and a second end portion spaced from said first end portion, dislodging means connected to said boom assembly second end portion, conveying means connected to said mobile frame assembly for receiving material from said dislodging means, four individual retaining means secured to said mobile frame assembly front end portion, each said retaining means secured to said mobile frame assembly at a predetermined location along an axis transverse to a longitudinal axis of said mobile frame assembly, and four individual engaging means extending longitudinally from said boom assembly first end portion, each said engaging means pivotally connected by a pivot pin to one of said retaining means to allow said boom assembly to pivot in an upward and downward direction relative to said mobile frame assembly.

2. A continuous miner as set forth in claim 1 in which, each said retaining means secured to said mobile frame assembly has a generally U-shaped configuration for receiving an engaging means.

3. A continuous miner as set forth in claim 1 in which, each said retaining means and each said engaging means have aligned holes therethrough for receiving a retaining pin.

4. A continuous miner as set forth in claim 1 which includes, a plurality of actuating means connected between said mobile frame assembly front end portion and said boom assembly for vertically pivoting said boom assembly relative to said mobile frame assembly.

5. A continuous miner as set forth in claim 1 in which said conveying means includes, a conveyor first portion positioned substantially horizontally on said mobile frame assembly extending longitudinally from said mobile frame assembly front end portion to said mobile frame assembly rear end portion, and a conveyor second portion pivotally connected to said conveyor first portion, said conveyor second portion extending rearwardly from said mobile frame assembly rear end portion, said conveyor second portion having means for pivoting said conveyor second portion horizontally and vertically relative to said conveyor first portion.

6. A continuous miner comprising · a mobile frame assembly having a front end portion and a rear end portion, a boom assembly extending from said mobile frame assembly, said boom assembly having-a first end portion pivotally connected to said mobile frame assembly by a plurality of connecting means and a second end portion spaced from said first end portion, dislodging means connected to said boom assembly second end portion, conveying means connected to said mobile frame assembly for receiving material from said dislodging means, four individual retaining means secured to said mobile frame assembly front end portion, each said retaining means secured to said mobile frame assembly at a predetermined location along an axis transverse to a longitudinal axis of said mobile frame assembly, four individual engaging means extending longitudinally from said boom assembly first end portion, said engaging means pivotally connected to said retaining means to allow said boom assembly to pivot in an upward and downward direction relative to said mobile frame assembly, collecting means positioned on said mobile frame assembly for inducing a flow of air through said boom assembly hollow interior portion, a fan assembly positioned on said mobile frame assembly at said mobile frame assembly rear end portion, a duct assembly extending longitudinally along a side of said mobile frame assembly, said duct assembly having a pair of vertically extending side walls spaced from each other and a pair of horizontally extending top and bottom walls connected between said pair of vertically extending side walls, said duct assembly having an end portion connected with said fan assembly and an opposite end portion extending between a pair of said retaining means, and said opposite end portion horizontally extending top and bottom walls having a first pair of arcuate end portions extending upwardly and downwardly from said top and bottom walls respectively.

7. A continuous miner as set forth in claim 6 in which said boom assembly includes, a vertically extending, generally transverse front wall, a pair of vertically extending, generally longitudinal outer sidewalls spaced from each other and connected to said vertically extending, generally transverse front wall, a pair of horizontally extending top and bottom walls spaced from each other, said pair of horizontally extending top and bottom walls connected to said pair of vertically extending, generally longitudinal outer sidewalls and said vertically extending transverse front wall, said pair of horizontally extending top and bottom walls each having a rear edge surface, a pair of generally U-shaped cutout portions extending from said top and bottom walls rear edge surfaces a preselected distance into said top and bottom walls, said top wall generally U-shaped cutout portion in overlying relation with said bottom wall generally U-shaped cutout portion, and a pair of vertically extending longitudinal inner sidewalls extending between said top and bottom walls generally U-shaped cutout portions, said pair of vertically extending longitudinal inner sidewalls being parallel with a portion of said pair of vertically extending, generally longitudinal outer sidewalls.

8. A continuous miner as set forth in claim 7 in which, a portion of each said vertically extending, generally longitudinal outer sidewall and a portion of each said vertically extending inner sidewall extends longitudinally from said horizontally extending top and bottom walls rear edge surfaces to form said engaging means.

9. A continuous miner as set forth in claim 7 in which, said horizontally extending top and bottom walls and said vertically extending generally longitudinal outer sidewalls form said boom assembly hollow interior portion.

10. A continuous miner as set forth in claim 7 which includes, an opening in said boom assembly horizontally extending top wall at said boom assembly second end portion to provide an air inlet portion connected to said boom assembly hollow interior portion.

11. A continuous miner as set forth in claim 7 in which, said boom assembly horizontally extending top and bottom walls include a second pair of arcuate end portions extending upwardly and downwardly from said top and bottom walls rear edge surfaces respectively, said second pair of arcuate end portions arranged to be pivotally retained within said duct assembly first pair of arcuate end portions to provide a pivoting joint.

12. A continuous miner as set forth in claim 11 in which, said fan assembly is operable to draw dust produced by said dislodging means through said boom assembly hollow interior portion and said pivoting joint into said mobile frame assembly duct assembly.

13. A continuous miner as set forth in claim 11 in which, said pivoting joint provide a means for drawing dust produced by said dislodging means through said boom assembly hollow interior portion into said mobile frame assembly duct assembly with said boom assembly in a predetermined vertical position relative to said mobile frame assembly.

* * * * *